US007213542B2

(12) United States Patent
Oshima et al.

(10) Patent No.: US 7,213,542 B2
(45) Date of Patent: May 8, 2007

(54) SADDLE RIDING TYPE VEHICLE

(75) Inventors: Tadashi Oshima, Saitama (JP); Katsumi Kanai, Saitama (JP); Takahiro Yanagisawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 101 days.

(21) Appl. No.: 10/942,987

(22) Filed: Sep. 17, 2004

(65) Prior Publication Data

US 2005/0092266 A1 May 5, 2005

(30) Foreign Application Priority Data

Sep. 29, 2003 (JP) ..... 2003-337645

(51) Int. Cl.
*F01P 3/20* (2006.01)

(52) U.S. Cl. ..... 123/41.51; 180/68.1; 180/219

(58) Field of Classification Search ..... 123/41.51; 180/68.1, 68.4, 219, 229
See application file for complete search history.

(56) References Cited

U.S. PATENT DOCUMENTS 5,330,029 A * 7/1994 Yoshimura et al. ..... 180/219
5,992,554 A * 11/1999 Hasumi et al. ..... 180/229

FOREIGN PATENT DOCUMENTS

JP 1-139022 U 9/1989
JP 02074484 A * 3/1990

* cited by examiner

*Primary Examiner*—Tony M. Argenbright
*Assistant Examiner*—Katrina Harris
(74) *Attorney, Agent, or Firm*—Birch, Stewart, Kolasch & Birch, LLP

(57) ABSTRACT

To decrease adhesion of dirt to a radiator, miniaturize the radiator in front of an engine and improve engine cooling performance by efficiently applying cooling air to the engine. An oil cooler includes a first oil cooler and a second oil cooler. The first oil cooler is disposed in front of an engine. The second oil cooler is disposed in a front cover at a position higher than an upper edge of a front wheel. The first oil cooler is disposed immediately in front of a cooling fan. The first oil cooler is disposed so as to close an air intake guide of the cooling fan less than 50%. The first oil cooler and the second oil cooler are serially connected along an oil line. A heat radiation area of the second oil cooler is larger than that of the first oil cooler.

19 Claims, 9 Drawing Sheets

SADDLE RIDING TYPE VEHICLE

BACKGROUND OF THE INVENTION

Cross-Reference to Related Applications

The present application claims priority under 35 USC 119 to Japanese Patent Application No. 2003-337645 filed on Sep. 29, 2003 the entire contents of which are hereby incorporated by reference.

1. Field of the Invention

The present invention relates to a saddle riding type vehicle having a cooling fan and a radiator for engine oil cooling disposed in front of an engine.

2. Description of Background Art

A saddle riding type vehicle is a four-wheel vehicle that is capable of being driven on uneven roads. A seat is provided at the top center with an engine disposed under the seat and a steering handle provided in front of the seat. In addition, a four-wheel-drive mechanism is provided for propelling the vehicle. A driver will sit astride the seat for driving. Generally, the engine is cooled by natural air cooling. A cooling fan for forced cooling may be provided in front of the engine.

It is known that a conventional saddle riding type vehicle having a cooling fan uses the cooling fan to cool an oil cooler as well as the engine. See, Japanese Utility Model Appln. Laid-Open Publication No. 1-139022.

FIG. 9 in the drawings corresponds to FIG. 1 in Japanese Utility Model Appln. Laid-Open Publication No. 1-139022.

A saddle riding type four-wheel vehicle 1 in Japanese Utility Model Appln. Laid-Open Publication No. 1-139022 includes front wheels 10 and a steering handle 9 provided at the front with a seat 19 disposed at the top center and an engine 13 that is mounted at the bottom. An engine cooling system is provided that includes a cooling fan 22 provided in front of the engine 13 and an oil cooler (heat exchanger) 23 provided adjacent to a lower half of the cooling fan 22. An upper part of the engine can be cooled by air supplied from an upper half of the cooling fan 22.

Special consideration is needed to be made with respect to the adhesion of dirt when the oil cooler (heat exchanger) 23 is disposed in front of the engine like the saddle riding type vehicle in Japanese Utility Model Appln. Laid-Open Publication No. 1-139022.

The configuration of the engine cooling system in Japanese Utility Model Appln. Laid-Open Publication No. 1-139022 uses many members such as a front pipe 7 in front of the oil cooler 23. To further improve output, for example, it is necessary to relatively increase the size of the oil cooler 23. In this case, cooling air supplied to the engine may decrease.

SUMMARY AND OBJECTS OF THE INVENTION

It is an object of the present invention to provide a saddle riding type vehicle designed to decrease adhesion of dirt to a radiator, miniaturize the radiator in front of an engine, and improve engine cooling performance by efficiently applying cooling air to the engine.

The present invention includes a saddle riding type vehicle which disposes an engine between front and rear wheels, forcedly cools the engine using a cooling fan disposed in front of the engine, cools engine oil using an externally disposed radiator, and covers the engine, radiator, and front wheels using a front cover. A rider will sit astride a seat provided above the engine for driving the vehicle. The radiator includes a first radiator and a second radiator wherein the first radiator is disposed in front of the engine and the second radiator is disposed in the front cover at a position higher than an upper edge of the front wheel.

The present invention includes the first radiator that is disposed immediately in front of the cooling fan.

The present invention includes the first radiator that is disposed so as to close an air intake guide of the cooling fan 50% or less.

The present invention includes the first and second radiators that are serially disposed along an oil line.

The present invention includes a heat radiation area of the second radiator that is greater than that of the first radiator.

The present invention includes an air intake channel that also used as a mud guard is provided in front of the second radiator.

According to the present invention, the radiator includes the first radiator and the second radiator. The first radiator is disposed in front of the engine. This makes it possible to miniaturize the first radiator. The cooling fan is disposed in front of the engine and generates wind that is efficiently applied to the engine. Thus, an advantage is provided to make it possible to improve the cooling performance of the engine.

The second radiator is disposed in the front cover at a position higher than the upper edge of the front wheel. The second radiator is less easily subject to adhesion of dirt and submersion under water than the first radiator.

According to the present invention, the first radiator is configured to be disposed immediately before the cooling fan. The first radiator can be exposed to wind generated by the cooling fan. It is possible to improve the cooling performance when the saddle riding type vehicle is operating a slow speeds or stops.

According to the present invention, the first radiator is disposed so as to close the air intake guide of the cooling fan less than 50%.

Closing the air intake guide greater than or equal to 50% decreases the amount of air supplied to the engine. When the saddle riding type vehicle is operating a slow speeds or stops, the engine's cooling performance degrades.

Closing the air intake guide less than 50% can reliably use 50% or more of the air intake guide to cool the engine. As a result, the cooling air is reliably applied to the engine, making it possible to improve the engine cooling performance.

According to the present invention, the first radiator and the second radiator are serially disposed along the oil line. Consequently, engine oil can be reliably supplied to both the first and second radiators. The first and second radiators can radiate the heat of the engine oil to the atmosphere.

Since the first and second radiators are serially disposed along the oil line, neither of the first and second radiators need to use branch pipes. Thus, the connection between the pipes does not become complicated and the number of hours of labor for connecting the pipes is decreased.

According to the present invention, the heat radiation area of the second radiator is larger than that of the first radiator. The second radiator can ensure heat radiation even if dirt adheres to the first radiator disposed in front of the engine to degrade the heat radiation performance of the first radiator. As a result, the radiator function can be maintained.

According to the present invention, the air intake channel is also used as a mud guard and is provided in front of the second radiator. Therefore, it is possible to more reliably guide the wind during operation from the front cover's opening to the second radiator.

The air intake channel also functions as a mud guard. The use of the air intake channel provides an advantage of preventing dirt from easily adhering to the second radiator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
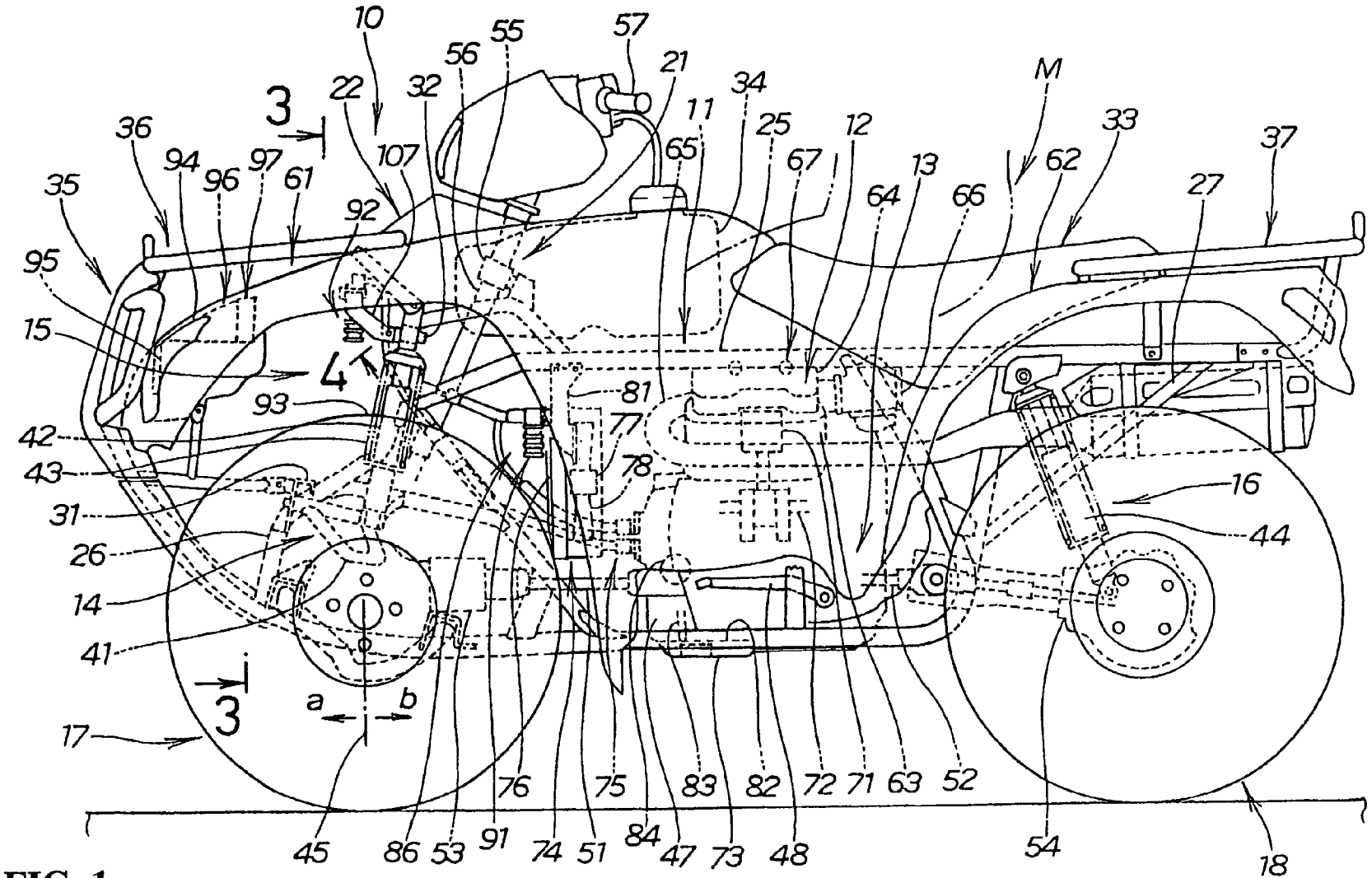
FIG. 1 is a side view of the saddle riding type vehicle according to the present invention.

The best mode for carrying out the invention will be described with reference to the accompanying drawings. Horizontal and vertical directions of the drawings are based on a direction along which the reference numerals are described.

FIG. 1 is a side view of a saddle riding type vehicle according to the present invention. A saddle riding type vehicle 10 includes a body frame 11, an engine 12 mounted at the top center of the body frame 11 and a transmission system 13 connected to the engine 12 and mounted on the body frame 11. A suspension system 14 (having front and rear suspensions 15 and 16) oscillatably holds the front and the rear of the transmission system 13, on the body frame 11. Front wheels 17 (see FIG. 2) are mounted on the right and the left in front of the transmission system 13. Rear wheels 18 (see FIG. 2) are mounted on the right and the left in the rear of the transmission system 13. A steering system 21 is coupled to the front wheels 17 and is mounted on the body frame 11. A fender 22 is mounted on the body frame 11. A rider M can sit astride a seat 33 provided over the engine 12 for driving the vehicle.

The body frame 11 includes a main frame 25 with front and rear frames 26 and 27 mounted on the front and the rear of the main frame 25. A bracket 31 is mounted between the right and the left under the front frame 26 with a cross member 32 mounted between the right and the left above the front frame 26. A seat 33 is mounted on the main frame 25. A fuel tank 34 is provided together with a front guard 35 mounted on the front frame 26. A front carrier 36 is mounted on the front frame 26 and a rear carrier 37 is mounted on the rear of the main frame 25.

The suspension system 14 is based on an independent suspension. A front suspension 15 includes a front arm 41 oscillatably mounted on the body frame 11 with a shock absorber 42 mounted between the front arm 41 and the cross member 32 and a coil spring 43. A rear suspension 16 has a shock absorber 44 mounted on the body frame 11. A center shaft line 45 of the front wheel 17 is provided.

The transmission system 13 includes a transmission 47 capable of four-wheel driving, a gear change pedal 48, front and rear drive axles 51 and 52 coupled to the front and the rear of the transmission 47, a front final deceleration system 53 coupled to the front drive axle 51 and mounted on the front arm 41 and a rear final deceleration system 54 coupled to the rear drive axle 52.

The steering system 21 includes a steering shaft 56 mounted on the top front of the main frame 25 by means of a shaft holder 55 and a handle 57 mounted on the steering shaft 56.

The fender 22 includes a front cover 61 and a rear cover 62. The front cover 61 will be described later.

The engine 12 is a four-cycle engine and includes a cylinder block 63, a cylinder head 64 mounted on the cylinder block 63, an exhaust system 65 connected to the front, a carburetor 66 mounted on the rear, a valve train 67 provided in the cylinder head 64, a piston 71 moving in the cylinder block 63, a crankshaft 72 coupled to the piston 71, an oil pan 73 disposed under the cylinder block 63, a cooling fan 74 disposed in front of the engine 12 to forcedly air-cool the engine and a lubrication mechanism 75.

The cooling fan 74 includes an electric motor 77 at the center of an air intake guide 76 with fan 78 attached to the electric motor 77. The electric motor 77 rotates the fan 78 based on information from a control system (not shown). The right and the left of the air intake guide 76 are fixed to the main frame 25 with lugs 81 (see FIG. 3).

The lubrication mechanism 75 supplies engine oil 82 to transmission gears of the transmission 47, the valve train 67, and the crankshaft 72. The lubrication mechanism 75 includes an oil strainer 83 disposed in the oil pan 73, an oil pump 84, an oil filter 85 (see FIG. 5) and an oil cooler 86 as a radiator.

The oil cooler (radiator) 86 includes a first oil cooler 91 as a first radiator and a second oil cooler 92 as a second radiator. The first oil cooler (first radiator) 91 is disposed in front of the engine 12. The second oil cooler (second radiator) 92 is disposed in the front cover 61 at a position higher than an upper edge 93 of the front wheel 17. The engine oil 82 is air-cooled.

The first oil cooler (first radiator) 91 is disposed immediately in front of the cooling fan 74.

The second oil cooler (second radiator) 92 is disposed almost immediately above the center shaft line 45 of the front wheel 17.

Depending on design conditions and the like, the second oil cooler (second radiator) 92 may be positioned forward (toward arrow a) or backward (toward arrow b) of the center shaft line 45 of the front wheel 17.

The front cover 61 covers the engine 12, the oil cooler (radiator) 86 and the front wheel 17. The front cover 61 is provided with right and left headlamps 94 (see FIG. 2). A first opening 95 is formed at the bottom center. A second opening 96 is formed at the rear of the first opening 95. A grille 97 is fit into the second opening 96.

Figure 2:
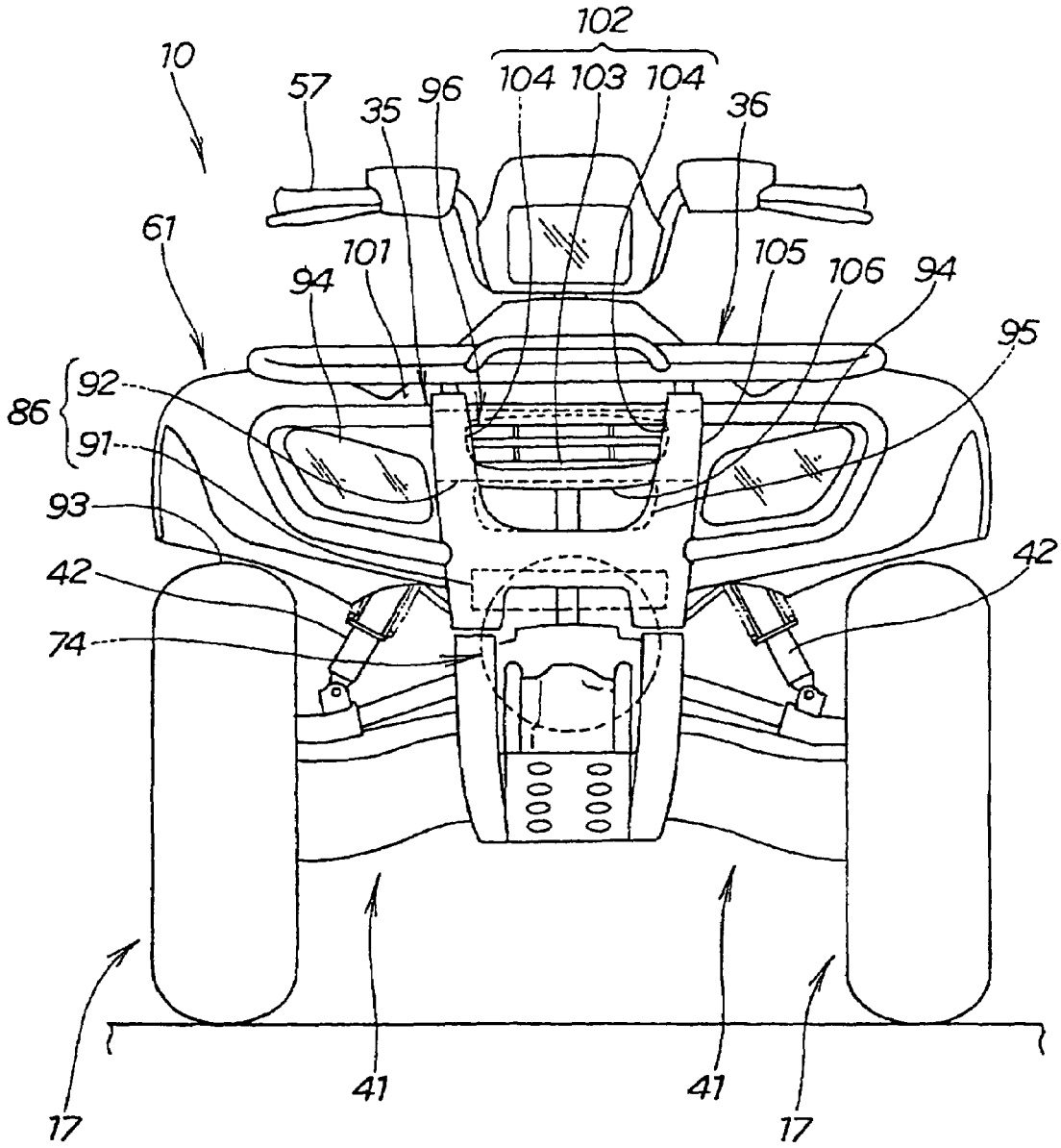
FIG. 2 is a front view of the saddle riding type vehicle according to the present invention.

FIG. 2 is a front view of the saddle riding type vehicle according to the present invention.

As mentioned above, the saddle riding type vehicle 10 forcedly air-cools the engine 12 (see FIG. 1) by using the cooling fan 74 disposed in front of the engine. The externally disposed oil cooler 86 is used to cool the engine oil 82 (see FIG. 1). The saddle riding type vehicle 10 is configured to cover the engine, the oil cooler 86 and the front wheels 17 with the front cover 61.

As mentioned above, the oil cooler 86 is a radiator whose second oil cooler 92 is disposed in the front cover 61 at a position higher than the top edge 93 of the front wheels 17.

The second opening 96 has an inlet channel 102 (bottom 103 and side walls 104) formed continuously with an external surface 101 of the front cover 61. The second opening 96 guides air toward the second oil cooler 92 during driving and improves ventilation when the saddle riding type vehicle 10 stops.

The front guard 35 has a vertical member 105 and a horizontal member 106. The vertical member 105 and the horizontal member 106 are mounted so as not to interfere with the first and second openings 95 and 96.

Figure 3:
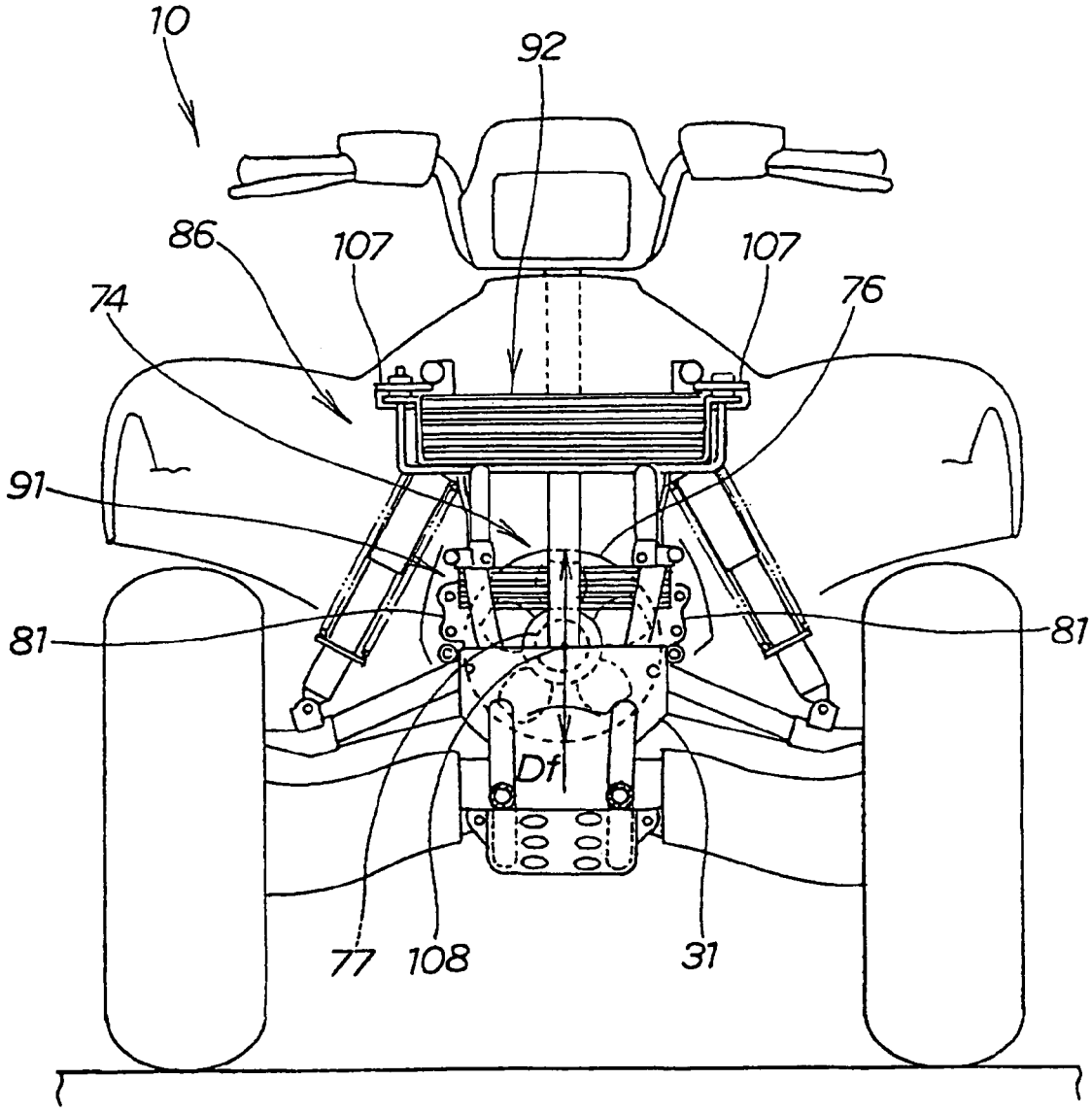
FIG. 3 is a cross-sectional view taken along the line 3—3 of FIG. 1.

FIG. 3 is a cross-sectional view taken along the line 3—3 of FIG. 1 for illustrating the cooling fan 74 and the oil cooler 86 (the first oil cooler 91 and the second oil cooler 92).

The first and second oil coolers 91 and 92 have almost the same configuration as that of existing oil coolers. Brackets 107 are provided for mounting the second oil cooler 92 on the body frame 11 (see FIG. 1).

The first oil cooler 91 is mounted on the body frame 11 (see FIG. 1) with the lugs 81.

The position of the first oil cooler 91 will now be described.

The first oil cooler 91 is disposed so as to close the air intake guide 76 of the cooling fan 74 less than 50%. More specifically, it is assumed that an inside diameter of the air intake guide 76 is Df and an area thereof is $Af(Af=\pi Df^2/4)$. The first oil cooler 91 is disposed so that the area Af of the air intake guide 76 will becomes less than 50%.

Closing the air intake guide 76 greater than or equal to 50% decreases the amount of air supplied to the engine 12 (see FIG. 1). When the saddle riding type vehicle 10 is operating at a slow speed or stops, the engine's cooling performance degrades.

Closing the air intake guide 76 less than 50% can reliably use a half (50% or more) of the area Af of the air intake guide 76 to cool the engine. As a result, the cooling air is reliably applied to the engine, making it possible to improve the engine cooling performance.

In this example, the first oil cooler 91 is disposed at an upper half, i.e., above a center shaft 108 of the electric motor 77 for the cooling fan 74. By contrast, the first oil cooler 91 may be disposed at a lower half. Further, depending on conditions, the first oil cooler 91 can be disposed at a left or right half against the center shaft 108.

The following describes heat radiation areas for the first and second oil coolers 91 and 92.

A heat radiation area of the second oil cooler 92 is configured to be larger than that of the first oil cooler 91. With respect to the projected areas viewed from the front, a projected area of the second oil cooler 92 is apparently larger than that of the first oil cooler 91.

This relation may be reversed depending on conditions. For example, the heat radiation area of the first oil cooler 91 can be made larger than that of the second oil cooler 92 so as to provide intended heat radiation performance under operating conditions.

The same heat radiation area may be used. When the heat radiation performance is available, the heat radiation area of the second oil cooler 92 may be the same as that of the first oil cooler 91.

Figure 4:
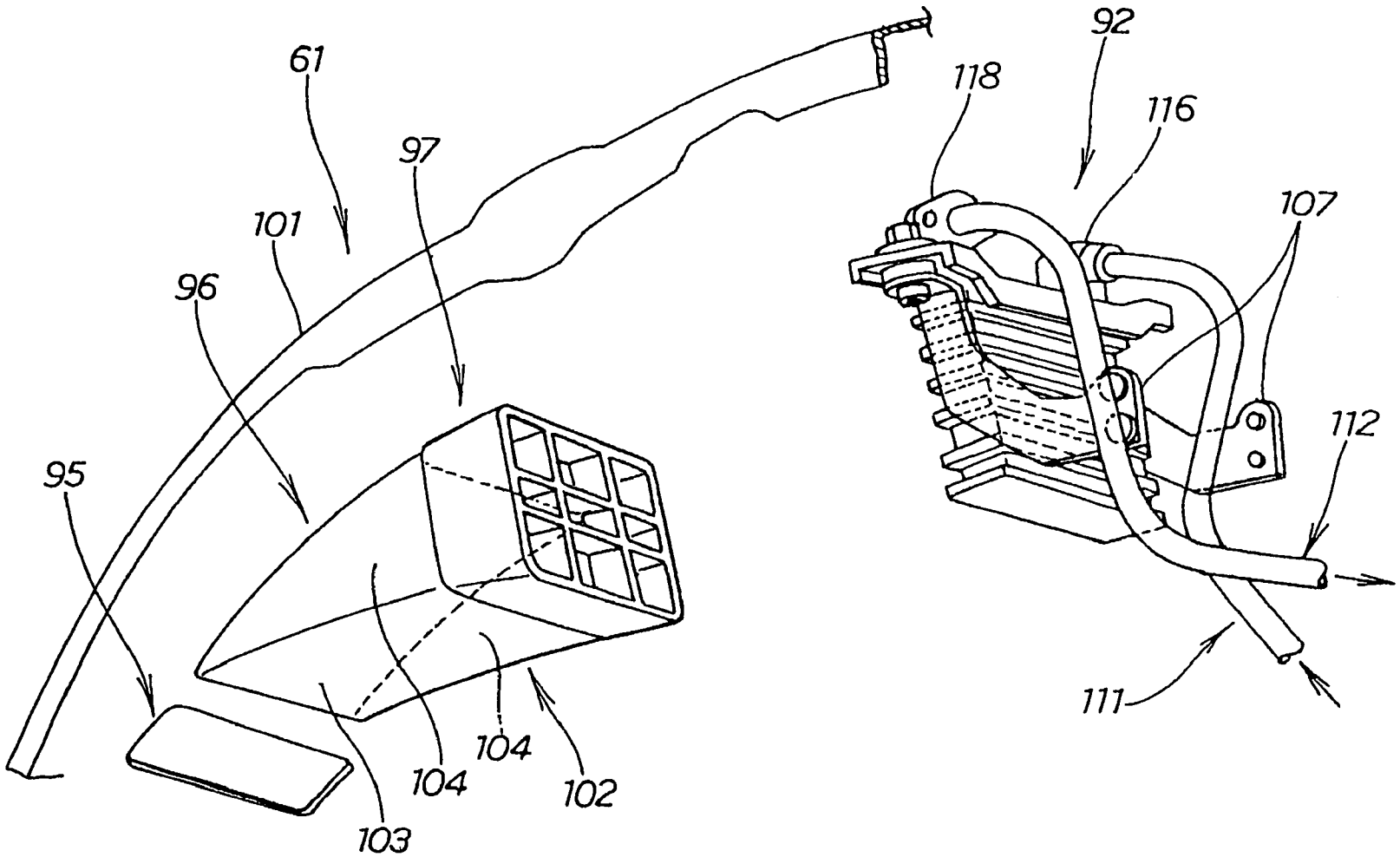
FIG. 4 is a perspective view taken in the direction of the arrow 4 of FIG. 1.

FIG. 4 is a perspective view taken in the direction of the arrow 4 of FIG. 1 and shows the second oil cooler 92, the grille 97, the second opening 96 and the first opening 95.

As mentioned above, the second opening 96 has the inlet channel 102. The inlet channel 102 has the bottom 103 and the side walls 104 formed continuously with the external surface 101 of the front cover 61. The inlet channel 102 is an air intake slot almost straight facing the second oil cooler 92.

The grille 97 mainly aims at preventing foreign particles from entering and regulating air flow and may be formed in any configuration or design.

Figure 5:
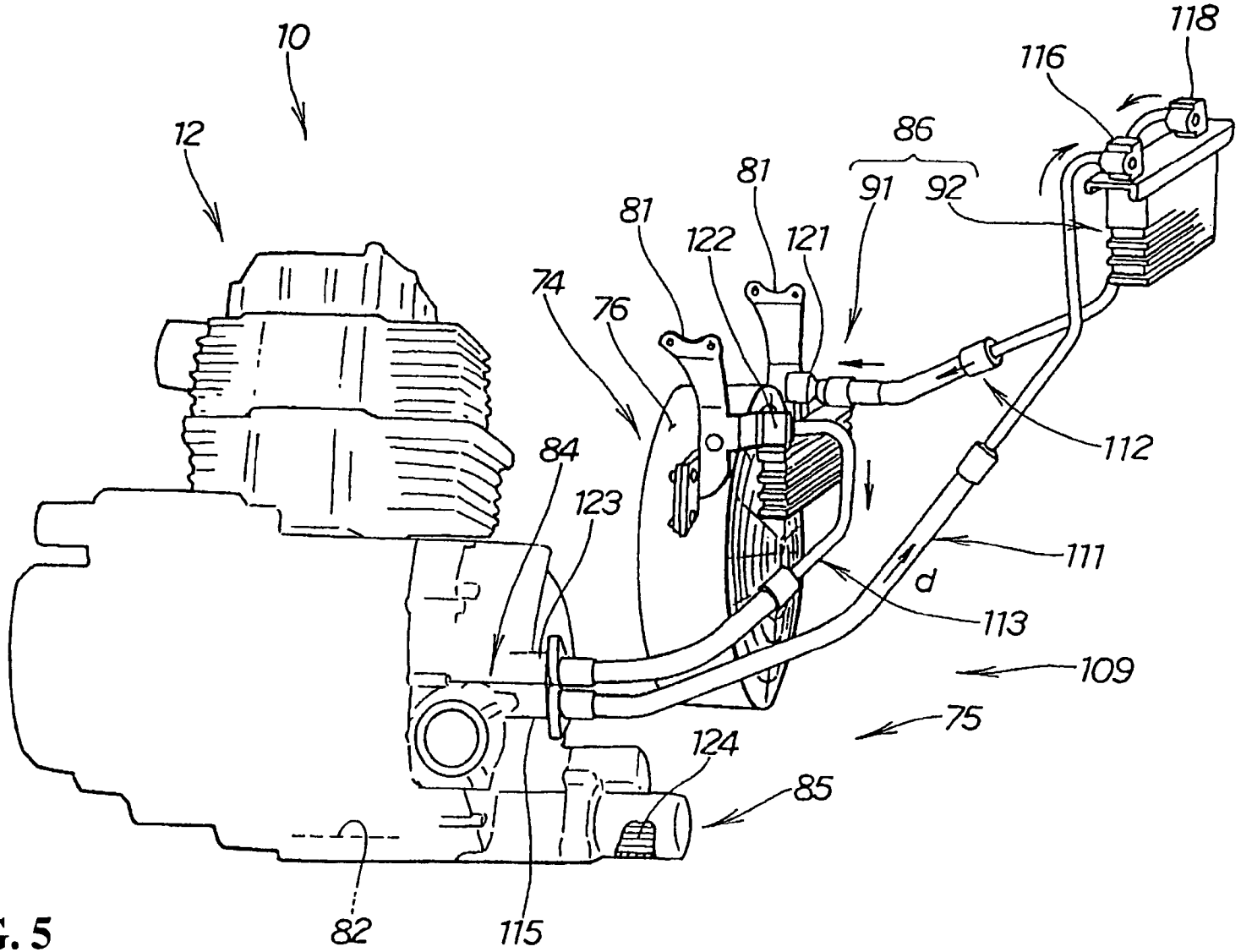
FIG. 5 is a perspective view of piping for the radiator used for the saddle riding type vehicle according to the present invention.

FIG. 5 is a perspective view of the piping of the radiator used for the saddle riding type vehicle according to the present invention. FIG. 5 shows the oil cooler 86 as the radiator as well as a lubrication mechanism 75 (oil pump 84 and oil filter 85) and the first oil cooler (first radiator) 91 of the engine 12 disposed immediately in front of the cooling fan 74.

The lubrication mechanism 75 serially disposes the first oil cooler (first radiator) 91 and the second oil cooler (second radiator) 92 along the oil line 109. The oil line 109 represents the whole of lubrication routes. First through third pipes 111 through 113 are used to serially connect the first and second oil coolers 91 and 92. More specifically, one end of the first pipe 111 is connected to an outlet 115 of the oil filter 85. The other end of the first pipe 111 is connected to an inlet 116 of the second oil cooler 92. One end of the second pipe 112 is connected to an outlet 118 of the second oil cooler 92. The other end of the second 112 is connected to an inlet 121 of the first oil cooler 91. One end of the third pipe 113 is connected to an outlet 122 of the first oil cooler 91. The other end of the third pipe 113 is connected to a supply port 123.

The following partly summarizes a flow of engine oil 82.

The engine oil 82 is ejected from the oil pump 84, passes through a filter body 124 of the oil filter 85 and once exits from the outlet 115 of the oil filter 85. The engine oil 82 then flows through the first pipe 111 as indicated by the arrow d, further flows through the second oil cooler 92, the second pipe 112, the first oil cooler 91 and the third pipe 113 in order and then is supplied to the above-mentioned parts from the supply port 123.

While the engine oil has been described as cooling fluid cooled by the radiator, cooling fluids other than the engine oil can include water for a water-cooled system. Water used for the water-cooled system includes water for a water-cooled engine, a water-cooled oil cooler and water-cooled electric parts.

The following describes the effects of the radiator used for the above-mentioned saddle riding type vehicle.

Figure 6:
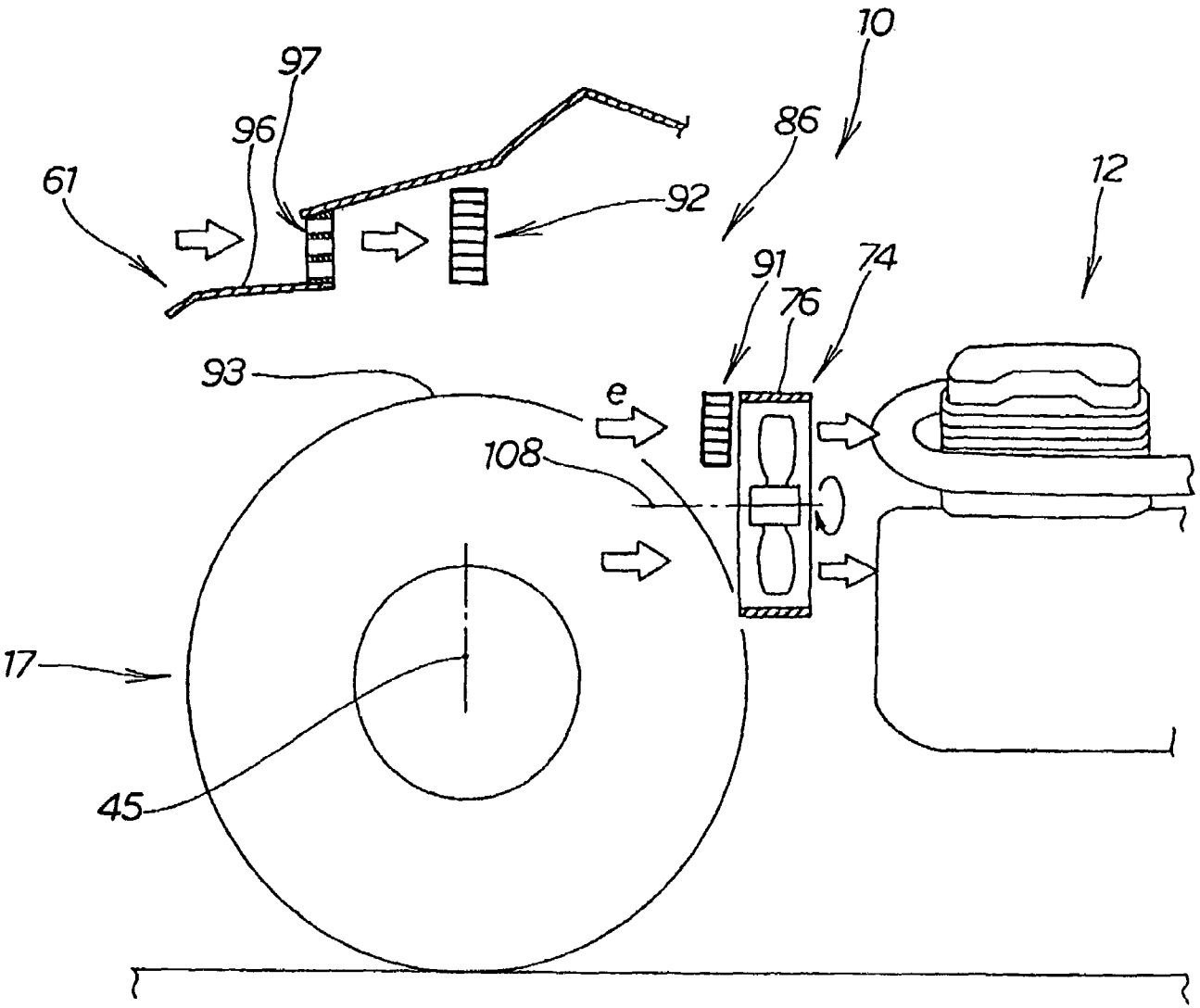
FIG. 6 is an operation diagram of the radiator used for the saddle riding type vehicle according to the present invention.

FIG. 6 is an operational diagram of the radiator used for the saddle riding type vehicle according to the present invention.

The oil cooler 86 includes the first oil cooler 91 and the second oil cooler 92. The first oil cooler 91 is disposed at the rear of the engine 12. This makes it possible to miniaturize the first oil cooler 91. The cooling fan 74 is disposed in front of the engine 12 and generates wind that is efficiently applied to the engine. Thus, it is possible to improve the cooling performance of the engine 12.

In the oil cooler 86, the second oil cooler 92 is disposed in the front cover 61 at a position higher than the upper edge 93 of the front wheel 17. The second oil cooler 92 is less easily subject to adhesion of dirt and submersion under water than the first oil cooler 91.

The first oil cooler 91 is configured to be disposed immediately before the cooling fan 74. The first oil cooler 91 can be exposed to wind generated by the cooling fan 74 as indicated by the arrow e. Thus, it is possible to improve the cooling performance of the oil cooler 86 when the saddle riding type vehicle 10 is operating at slow speeds or stops.

The first oil cooler 91 is disposed so as to close the air intake guide 76 of the cooling fan 74 less than 50%. Accordingly, it is possible to reliably use 50% or more of the air intake guide 76 for cooling the engine. As a result, the cooling wind can be reliably applied to the engine 12 to improve the engine's cooling performance.

As shown in FIG. 5, the first oil cooler 91 and the second oil cooler 92 are serially disposed along the oil line 109. Consequently, engine oil can be reliably supplied to both the first and second oil coolers 91 and 92. The first and second oil coolers 91 and 92 can radiate the heat of the engine oil to the atmosphere.

Since the first and second oil coolers 91 and 92 are serially disposed along the oil line 109, the each of the first and second oil coolers 91 and 92 do not need to use branch pipes that are needed for a parallel connection. Thus, the connection between pipes does not become complicated and the labor hours for connecting the pipes is decreased.

As shown in FIG. 3, the heat radiation area of the second oil cooler 92 is larger than that of the first oil cooler 91. The second oil cooler 92 can ensure heat radiation even if dirt adheres to the first oil cooler 91 disposed in front of the engine to degrade the heat radiation performance of the first oil cooler. As a result, the radiator function can be maintained.

Figure 7:
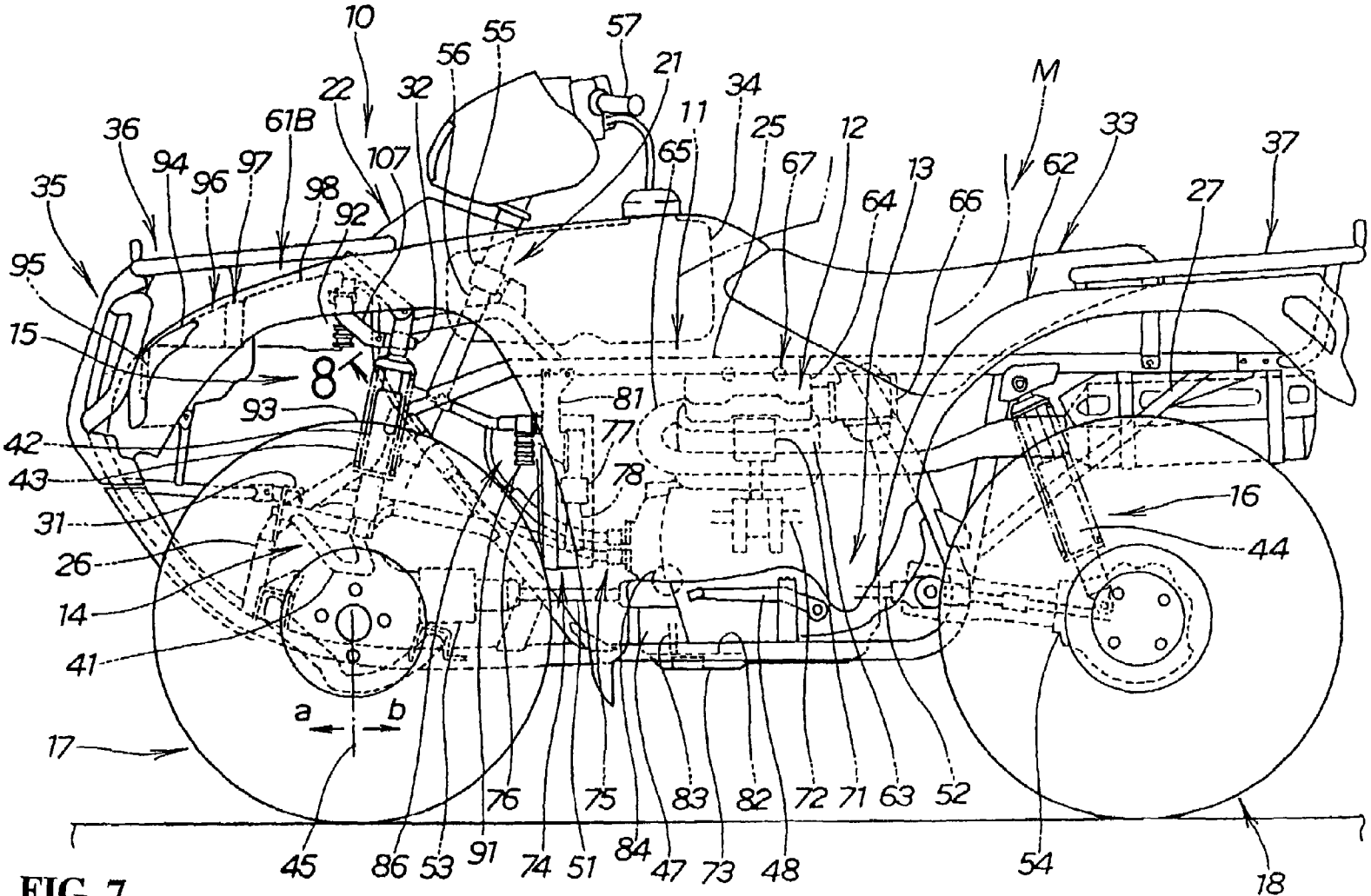
FIG. 7 is a side view of another embodiment.

FIG. 7 is a side view of another embodiment. The mutually corresponding parts in FIGS. 7 and 1 are designated by the same reference numerals and a detailed description is omitted for simplicity.

A front cover 61B covers the engine 12, the oil cooler (radiator) 86 and the front wheels 17. The front cover 61 is provided with right and left headlamps 94 (see FIG. 2). The first opening 95 is formed at the bottom center. The second opening 96 is formed at the rear of the first opening 95. The grille 97 is fit into the second opening 96. An air intake channel 98 which also functions as a mud guard is provided at the rear of the grille 97 and in front of the second oil cooler (second radiator) 92.

Figure 8:
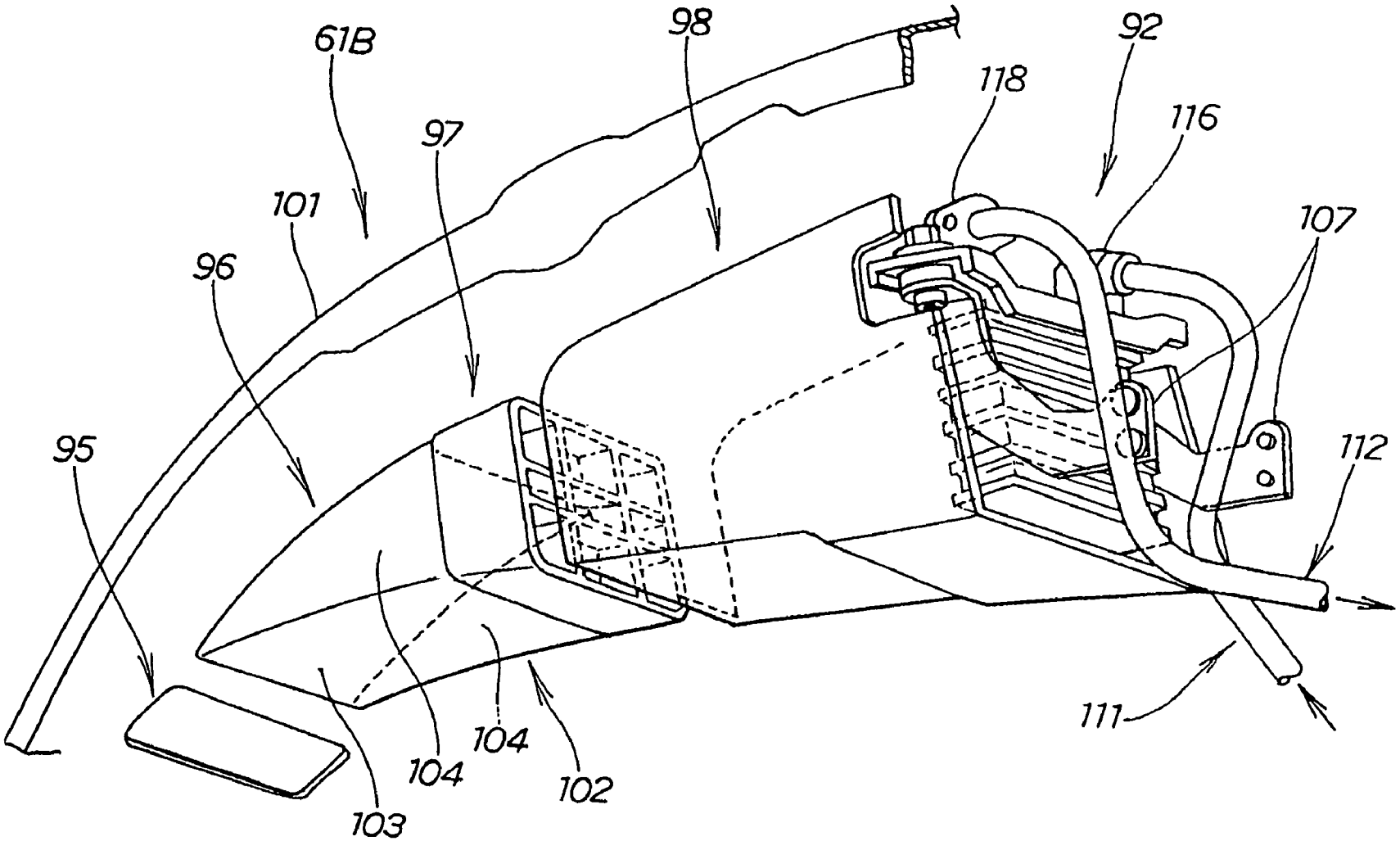
FIG. 8 is a perspective view taken in the direction of the arrow 8 of FIG. 7.
Figure 9:
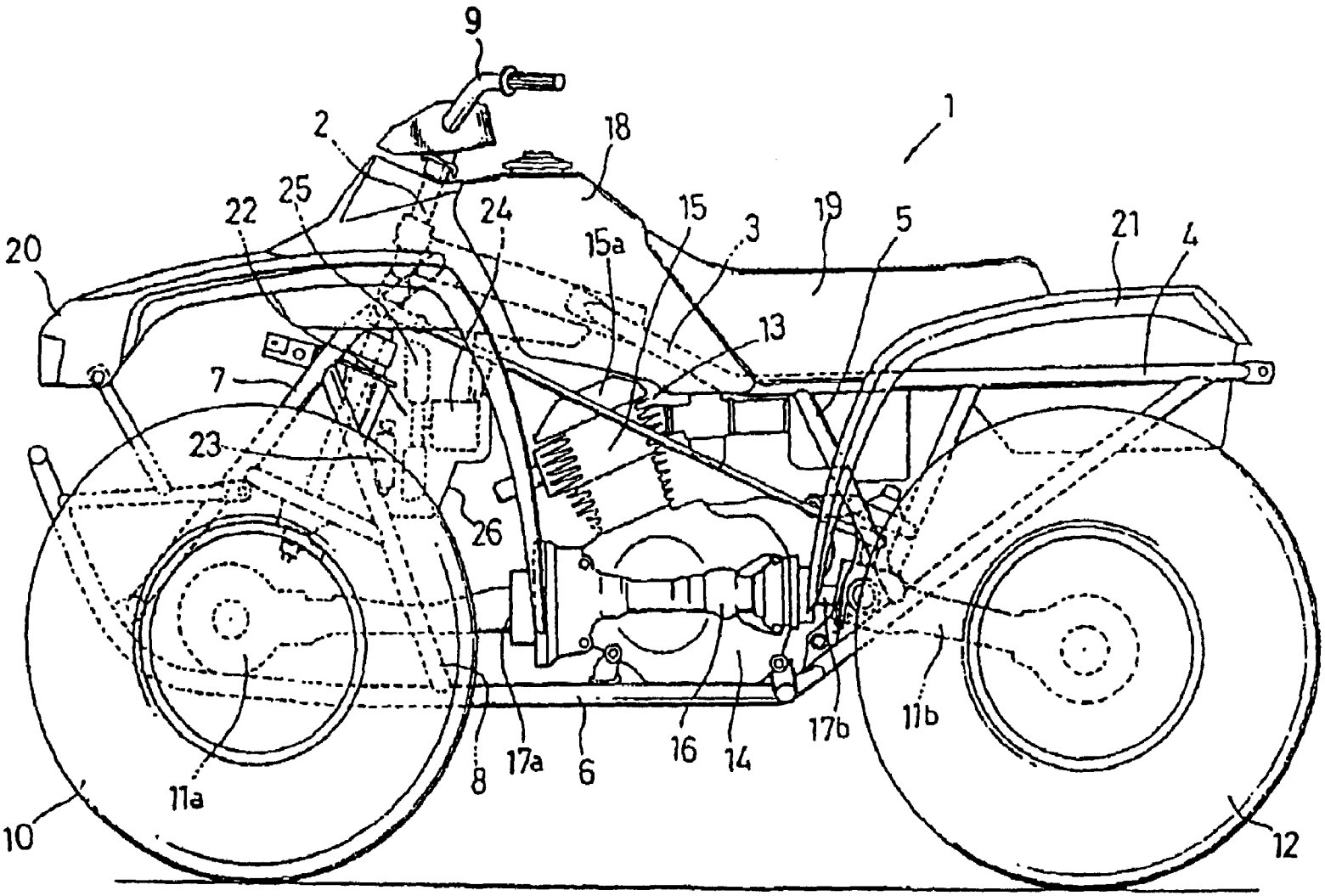
BACKGROUND ART FIG. 9
FIG. 9 is a reproduction of FIG. 1 in paten JP 1-139022.

FIG. 8 is a perspective view taken in the direction of the arrow 8 of FIG. 7. The mutually corresponding parts in FIGS. 8 and 4 are designated by the same reference numerals and a detailed description is omitted for simplicity.

The air intake channel 98 has an angled U-shaped cross-sectional view and can more reliably guide the wind during operation of the vehicle from the rear of the second opening 96 to the second oil cooler 92.

The air intake channel also functions as a mud guard. The use of the air intake channel prevents dirt from easily adhering to the second oil cooler 92.

More particularly, the air intake channel 98 can prevent scattered things such as gravel stones from easily hitting against the second oil cooler 92.

While the embodiments of the saddle riding type vehicle according to the present invention are applied to four-wheel vehicles, the saddle riding type vehicle can be also applied to three-wheel and two-wheel vehicles as well as general vehicles.

The saddle riding type vehicle according to the present invention is suitable for four-wheel vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A saddle riding type vehicle wherein an engine is disposed between front and rear wheels, a cooling fan for forcedly cooling said engine is disposed in front of said engine, an externally disposed radiator is provided for cooling engine oil, a front cover is mounted over said engine, radiator and front wheels for allowing a rider to sit astride a seat provided above said engine for driving comprising:

said radiator includes a first radiator and a second radiator;

said first radiator is disposed in front of said engine; and said second radiator is disposed at a position higher than the cooling fan.

2. The saddle riding type vehicle according to claim 1, wherein said first radiator is disposed so as to close an air intake guide of said cooling fan 50% or less.

3. The saddle riding type vehicle according to claim 1, wherein said first and second radiators are serially disposed along an oil line.

4. The saddle riding type vehicle according to claim 1, wherein a heat radiation area of said second radiator is greater than that of said first radiator.

5. The saddle riding type vehicle according to claim 1, wherein an air intake channel forming a mud guard is provided in front of said second radiator.

6. The saddle riding type vehicle according to claim 1, wherein said first radiator is disposed immediately in front of said cooling fan.

7. The saddle riding type vehicle according to claim 6, wherein said first radiator is disposed so as to close an air intake guide of said cooling fan 50% or less.

8. A saddle riding type vehicle comprising:

an engine disposed between front and rear wheels;

a cooling fan for forcedly cooling said engine, said cooling fan being disposed in front of said engine;

an externally disposed radiator for cooling engine oil;

a front cover mounted over said engine, radiator and front wheels for allowing a rider to sit astride a seat provided above said engine for driving the vehicle;

said radiator includes a first radiator and a second radiator;

said first radiator being disposed in front of said engine; and said second radiator being disposed at a position higher than the cooling fan.

9. The saddle riding type vehicle according to claim 8, wherein said first radiator is disposed so as to close an air intake guide of said cooling fan 50% or less.

10. The saddle riding type vehicle according to claim 8, wherein said first and second radiators are serially disposed along an oil line.

11. The saddle riding type vehicle according to claim 8, wherein a heat radiation area of said second radiator is greater than that of said first radiator.

12. The saddle riding type vehicle according to claim 8, wherein an air intake channel forming a mud guard is provided in front of said second radiator.

13. The saddle riding type vehicle according to claim 8, wherein said first radiator is disposed immediately in front of said cooling fan.

14. The saddle riding type vehicle according to claim 13, wherein said first radiator is disposed so as to close an air intake guide of said cooling fan 50% or less.

15. A radiator adapted for use with a saddle riding type vehicle comprising:

a first radiator for cooling an engine fluid, said first radiator being adapted to be mounted in front of an engine; and a second radiator operatively connected to said first radiator, said second radiator being adapted to be mounted at a location displaced higher than said first radiator and away from a line of flow of cooling air received by said first radiator, wherein said first radiator is disposed immediately in front of a cooling fan.

16. The saddle riding type vehicle according to claim 15, wherein said first radiator is disposed so as to close an air intake guide of a cooling fan 50% or less.

17. The saddle riding type vehicle according to claim 15, wherein said first radiator is disposed so as to close an air intake guide of said cooling fan 50% or less.

18. The saddle riding type vehicle according to claim 15, wherein said first and second radiators are serially connected.

19. The saddle riding type vehicle according to claim 15, wherein a heat radiation area of said second radiator is greater than that of said first radiator.

* * * * *